United States Patent [19]

Simon

[11] Patent Number: 4,489,701

[45] Date of Patent: Dec. 25, 1984

[54] METHOD AND FUEL SUPPLY SYSTEM FOR FUEL SUPPLY TO A MIXTURE-COMPRESSING INTERNAL COMBUSTION ENGINE WITH EXTERNALLY SUPPLIED ENGINE

[75] Inventor: Nikolaus Simon, Gerlingen, Fed. Rep. of Germany

[73] Assignee: Robert Bosch GmbH, Stuttgart, Fed. Rep. of Germany

[21] Appl. No.: 616,798

[22] Filed: Jun. 5, 1984

Related U.S. Application Data

[63] Continuation of Ser. No. 397,967, Jul. 14, 1982, abandoned.

[30] Foreign Application Priority Data

Sep. 10, 1981 [DE] Fed. Rep. of Germany ..... 3135817

[51] Int. Cl.[3] ..... F02M 17/00; F02M 23/00

[52] U.S. Cl. ..... 123/531; 123/432

[58] Field of Search ..... 123/432, 531, 445, 463, 123/585, 586, 587; 261/78 R, DIG. 51, 145, DIG. 39

[56] References Cited

U.S. PATENT DOCUMENTS

| | | | |
|---|---|---|---|
| 1,279,775 | 9/1918 | Sprado | 123/531 |
| 1,470,820 | 10/1923 | Godfrey-Evans | 123/531 |
| 3,285,233 | 11/1966 | Jackson | 123/531 |
| 3,674,245 | 7/1972 | Massarotti | 123/531 |
| 3,834,364 | 9/1974 | Bartholemow | 123/531 |
| 3,970,063 | 7/1976 | Mayr et al. | 123/531 |
| 4,159,703 | 7/1979 | Mayer | 123/531 |
| 4,216,174 | 8/1980 | Szott et al. | 123/531 |
| 4,224,904 | 9/1980 | Clerk | 123/531 |
| 4,294,213 | 10/1981 | Sumiyashi et al. | 123/531 |
| 4,313,410 | 2/1982 | Kunii et al. | 123/531 |
| 4,387,695 | 6/1983 | Höppel et al. | 123/531 |
| 4,387,696 | 6/1983 | Yago et al. | 123/531 |

*Primary Examiner*—Raymond A. Nelli

*Attorney, Agent, or Firm*—Edwin E. Greigg

[57] ABSTRACT

A method and a fuel supply system for supplying fuel to a mixture-compressing internal combustion engine with externally supplied ignition. The fuel supply system includes a nozzle having a flow cross section of a nozzle-like body which discharges into the intake tube. Compressed air furnished by a compressed air source enters through this flow cross section in the intake tube at a pressure such that at the narrowest point or throat area of the nozzle the air attains sonic speed. A fuel delivery line also discharges at the narrowest point or throat area of the nozzle, and fuel metered in accordance with engine operating characteristics is carried via this fuel delivery line downstream of a fuel metering valve. The quantity of air flowing through the nozzle should be a partial flow of the aspirated air quantity; for instance, it should not be greater than the idling air quantity of the engine, so that at little expense, a continuous flow of air through the nozzle can be effected at sonic speed. As a result, optimal preparation of the metered fuel occurs and no additional differential pressure valve is required at the fuel metering valve.

12 Claims, 1 Drawing Figure

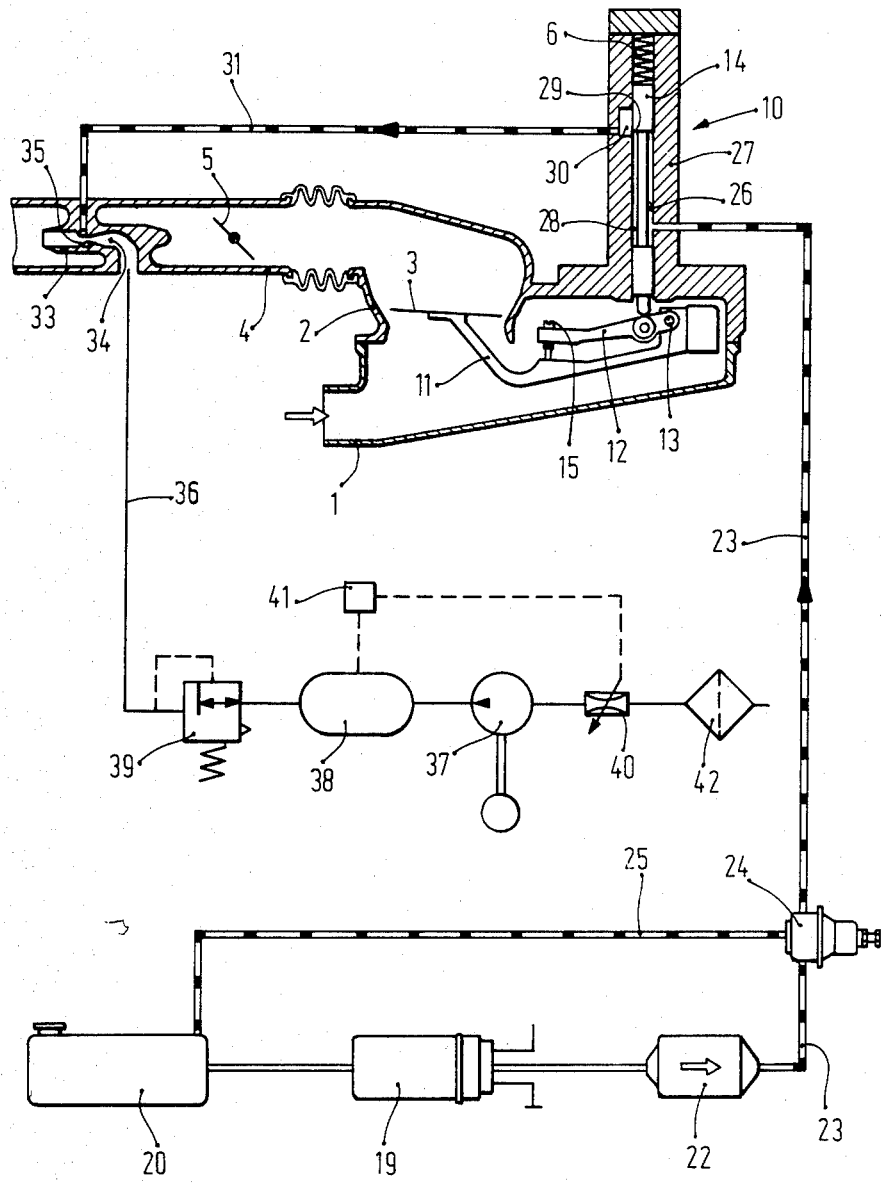
6
14
29
10
31
35
5
30
27
26
28
3
33
34
4
2
11
15
12
13
1
36
23
41
39
38
37
40
42
25
24
20
19
22
23

METHOD AND FUEL SUPPLY SYSTEM FOR FUEL SUPPLY TO A MIXTURE-COMPRESSING INTERNAL COMBUSTION ENGINE WITH EXTERNALLY SUPPLIED ENGINE

This is a continuation of copending application Ser. No. 397,967 filed July 14, 1982, now abandoned.

BACKGROUND OF THE INVENTION

The invention is based on a method for feeding fuel supply into the intake tube of a mixture-compressing internal combustion engine having externally supplied ignition, with fuel metering at a fuel metering valve in accordance with operating characteristics of the internal combustion engine and with the supply of fuel, prepared with air, as well as on a fuel supply system therefor. A method and a fuel supply system are already known in which metered fuel is aspirated into a fuel injection nozzle under the radiating stream action of a stream of compressed air blown into the nozzle and is injected into the intake tube. However, there is the disadvantage that the injected quantity of fuel is dependent on the intake tube pressure, and optimal preparation by the compressed air of the fuel injected via the fuel injection nozzle does not occur.

OBJECT AND SUMMARY OF THE INVENTION

The method according to the invention for supplying fuel to a mixture-compressing internal combustion engine with externally supplied ignition has the advantage over the prior art that with a relatively small quantity of air delivered from a compressed-air source to the nozzle and flowing at the speed of sound, optimal preparation of the fuel metered and delivered to the intake tube is accomplished, while the pressure difference at the fuel metering valve is simultaneously kept constant without requiring the disposition of a supplementary differential pressure valve. By means of the characteristics disclosed hereinafter, advantageous further embodiments of and improvements of the method and the fuel supply system disclosed in the application are possible. A particularly advantageous feature is the delivery of only a part of the quantity of air aspirated by the engine to the nozzle, this quantity being by way of example not greater than the quantity of air aspirated by the internal combustion engine during idling.

The invention will be better understood and further objects and advantages thereof will become more apparent from the ensuing detailed description of a preferred embodiment taken in conjunction with the drawing.

BRIEF DESCRIPTION OF THE DRAWING

A single exemplary embodiment of the invention is shown in simplified form in the drawing and will be described in further detail below.

DESCRIPTION OF THE EXEMPLARY EMBODIMENT

In the fuel supply system shown by way of example in the drawing, the combustion air flows in the direction of the arrow via an intake tube section 1 into a conical section 2, in which an air flow rate meter 3 has been disposed and further flows through an intake tube section 4 having an arbitrarily actuatable throttle valve 5 to one or more cylinders of a mixture-compressing internal combustion engine with externally supplied ignition (not shown). The air flow rate meter 3, shown by way of example, is a plate 3 disposed cross-wise to the flow direction, which moves within the conical section 2 of the intake tube in accordance with an approximately linear function, by way of example, of the quantity of air flowing through the intake tube. For a constant restoring force engaging the air flow rate meter 3, for instance a restoring spring 6, and a constant air pressure prevailing ahead of the air flow rate meter, the pressure prevailing between the air flow rate meter 3 and the throttle valve 5 likewise remains constant. Examples of air flow rate meters are hot-wire or hot-film air flow rate meters, spin throughput meters, ultrasound throughput meters, or similar devices. The air flow rate meter 3 controls a fuel metering valve 10. Transmission of the adjusting movement of the air flow rate meter 3 is effected by a pivoting lever 11 connected therewith, which is supported in common with a correction lever 12 on a pivoting point 13; when a pivoting movement occurs, the movable valve element of the fuel metering valve 10, embodied by way of example as a control slide 14, is actuated. The desired fuel-air mixture can be established at a mixture regulating screw 16. The restoring spring 6, which returns the air flow rate meter 3 to its original position, is supported on the end face of the control slide 14 remote from the pivoting lever 11. The restoring force may also be generated in a known manner by means of pressure fluid in place of the restoring spring 6.

The supply of fuel is effected by way of example by means of an electric fuel pump 19, which aspirates fuel from a fuel container 20 and delivers it to the fuel metering valve 10 by way of a fuel filter 22 and a fuel supply line 23. A system pressure regulating valve 24 of known design is disposed in the fuel supply line 23 and maintains a constant fuel pressure in the fuel supply line 23, permitting a portion of the delivered fuel to flow back to the fuel container 20 via a return flow line 25. The control slide 14 slides within a slide bore 26 of the fuel metering valve housing 27 and together with the sliding bore 26 forms an annular groove 28, which is defined on one end by a control edge 29 of the control slide 14. Depending upon the axial position of the control slide 14, the control edge 29 opens a control slit 30 in the fuel metering valve housing 27 to a greater or lesser extent, so that fuel is capable of proceeding in metered fashion out of the annular groove 28 via the control slit 30 into a fuel delivery line 31.

In the intake tube section 4 downstream of the throttle valve 5, a nozzle 33 is disposed, by way of example, coaxially with the intake tube; the nozzle 33 can be exposed to the flow about it on all sides of the air aspirated by the engine and has a flow cross section 34 with a nozzle-like course. The fuel delivery line 31 discharges at the narrowest point 35 of the flow cross section 34, and the metered fuel proceeds via this fuel delivery line 31 into an air flow flowing with the speed of sound at this point. To this end, the flow cross section 34 has its end remote from the intake tube disposed at an air line 36, into which an air pump 37 delivers air via an air reservoir 38 and a pressure regulating valve 39 at an underpressure, for instance 0.9 bar. The air quantity delivered to the nozzle 33 via the air line 36 should not be greater than the idling air quantity aspirated by the engine, preferably being from 70 to 90% of the idling air quantity. A variable throttle valve 40, which is adjustable in accordance with the pressure in the air reservoir 38 via a regulating member 41, is disposed on the intake side of the air pump 37. An air filter 42 is efficaciously provided upstream of the throttle valve 40. Air is delivered from the compressed-air source 37, 38 to the nozzle 33 at a pressure such that the speed of sound always prevails at the narrowest point of the flow cross section 34. As a result, a constant underpressure always prevails in the fuel delivery line 31 downstream of the control slit 30, so that a constant pressure difference always prevails at the control slit 30 without requiring the provision of a supplementary differential pressure valve, because the fuel pressure upstream of the control slit 30 is regulated to a constant value by the system pressure regulating valve 24. It is not necessary for a fuel pressure above atmospheric pressure to be built up in the fuel supply line 23; instead, the pressure drop from atmospheric pressure down to the pressure at the narrowest point 35 at the nozzle 33 is fully sufficient, when air is flowing past at the speed of sound, for transporting fuel from a fuel supply container via the fuel metering valve 10 to the nozzle 33. The method according to the invention and the fuel supply system according to the invention offer the advantage of very good atomization of the metered valve by the air flowing at the speed of sound, as a result of which the homogeneous mixture assures highly uniform distribution to the individual cylinders of the internal combustion engine. The optimally prepared mixture necessitates less enrichment in the case of cold starting and warmup of the engine, so that there is a reduction in fuel consumption as well as a reduction in the proportion of toxic exhaust gas components. As a result of the constant pressure downstream of the control slit 30 effected by the air flowing through the nozzle 33 at the speed of sound, no additional differential pressure valve is required at the fuel metering valve 10, and the metering of fuel is effected exclusively by means of the cross sectional control in the fuel metering valve 10, independently of any pressure changes in the intake tube.

The foregoing relates to a preferred exemplary embodiment of the invention, it being understood that other embodiments and variants thereof are possible within the spirit and scope of the invention, the latter being defined by the appended claims.

What is claimed and desired to be secured by Letters Patent of the United States is:

1. A method for feeding a fuel supply into an intake tube of a mixture-compressing internal combustion engine having externally supplied ignition, with fuel metering at a fuel metering valve and with the supply of fuel, mixed with air, comprising delivering fuel into a fuel nozzle disposed within said intake tube, said fuel being delivered to said nozzle at a point of least cross section which forms the throat area of said nozzle and therefrom into said intake tube, and feeding air from a compressed air source in proximity to said nozzle upstream from said nozzle area of least cross section, and through said throat area, whereby the compressed air is provided at a pressure and the throat area of least cross section is configured such that said compressed air flows through said throat area at a velocity which is equal to or greater than the speed of sound.

2. A method as defined by claim 1, in which the flowing air from the compressed-air source under constant pressure from the nozzle corresponds to only a part of the quantity of air aspirated by the engine.

3. A method as defined by claim 2, further in which the flowing air from the compressed-air source under constant pressure to the nozzle is not larger than the idling air quantity aspirated by the engine.

4. A method as defined by claim 2, which further includes pumping air into an air reservoir, from which the air proceeds via an air line having a pressure regulating valve to said nozzle under constant pressure.

5. A method as defined by claim 3, which further includes pumping air into an air reservoir, from which the air proceeds via an air line having a pressure regulating valve to said nozzle under constant pressure.

6. A system for supplying fuel mixed with air to a mixture-compressing internal combustion engine comprising:

an air intake tube;

a fuel nozzle disposed within said air intake tube;

means for delivering fuel into said fuel nozzle disposed within said air intake tube at a point of least cross section of said nozzle which forms the throat area of said nozzle and from said fuel nozzle into said air intake tube;

means for delivering compressed air from a compressed air source to said nozzle upstream from said nozzle area of least cross section and through said throat area of said nozzle, whereby said compressed air is delivered at a pressure and the throat area of least cross section is configured such that said compressed air flows through said throat area at a velocity which is equal to or greater than the speed of sound.

7. A system as defined by claim 5, further in which said nozzle is supplied by said compressed-air means sure upstream of said fuel metering valve and the pressure of the air flowing at sonic speed in said throat area of said nozzle.

8. A fuel supply system as defined by claim 6, further in which the fuel is metered by a fuel metering valve at a constant pressure difference, said constant pressure difference being determined by the constant fuel pressure with an air quantity under constant pressure which corresponds to only a part of the air quantity aspirated by said engine.

9. A fuel supply system as defined by claim 6, further in which said nozzle is disposed concentrically in said intake tube and air entering said intake tube encircles said nozzle.

10. A system as defined by claim 7, further in which said nozzle is supplied by said compressed air means with an air quantity under constant pressure which is not greater than the idling air quantity aspirated by said engine.

11. A system as defined by claim 7, further in which an air pump serves as said compressed-air means, said air pump in communication with a subsequent reservoir, from which the air proceeds via an air line having a pressure regulating valve to said nozzle under constant pressure.

12. A system as defined by claim 10, further in which an air pump serves as said compressed-air means, said air pump in communication with a subsequent reservoir, from which the air proceeds via an air line having a pressure regulating valve to said nozzle under constant pressure.

* * * * *